US007357008B2

(12) United States Patent
Yu

(10) Patent No.: US 7,357,008 B2
(45) Date of Patent: Apr. 15, 2008

(54) BUCKLE WITH DUAL LOCKING DEVICE

(76) Inventor: Chun Te Yu, No. 253, Sec. 3, Yanhai Rd., Fusing Township, Changhua County, 506 (TW)

( * ) Notice: Subject to any disclaimer, the term of this patent is extended or adjusted under 35 U.S.C. 154(b) by 0 days.

(21) Appl. No.: 11/437,691

(22) Filed: May 22, 2006

(65) Prior Publication Data

US 2006/0207302 A1 Sep. 21, 2006

Related U.S. Application Data

(63) Continuation-in-part of application No. 10/792,875, filed on Mar. 5, 2004.

(30) Foreign Application Priority Data

Sep. 30, 2005 (TW) ..... 94134386 A

(51) Int. Cl.
*E05B 73/00* (2006.01)

(52) U.S. Cl. ..... 70/58; 70/69; 70/284; 70/285; 70/DIG. 63; 70/DIG. 71

(58) Field of Classification Search ..... 70/18, 70/21, 58, 69–72, 74, 284, 285, DIG. 63, 70/DIG. 71
See application file for complete search history.

(56) References Cited

U.S. PATENT DOCUMENTS 5,193,368 A * 3/1993 Ling ..... 70/30
6,016,675 A * 1/2000 Te ..... 70/312
6,883,354 B1 * 4/2005 Yu ..... 70/18
6,912,879 B1 7/2005 Yu
7,032,415 B2 4/2006 Young
7,104,095 B1 * 9/2006 Lin ..... 70/58
2005/0092039 A1 * 5/2005 Mak et al. ..... 70/58
2005/0155397 A1 * 7/2005 Yu ..... 70/58
2006/0081022 A1 * 4/2006 Yu ..... 70/58

* cited by examiner

*Primary Examiner*—Lloyd A. Gall
(74) *Attorney, Agent, or Firm*—Rosenberg, Klein & Lee

(57) ABSTRACT

A buckle comprises a female fastener, a male fastener, a movable member, a key lock and a combination lock. The female fastener has a mounting opening, an insertion opening and two side holes defined respectively on different sides of the female fastener. The male fastener is provided for inserting into the female fastener and has two elastic pillars. Each one of the two elastic pillars has an outward projection for inserting into corresponding one of the two side holes. The movable member is installed in the mounting opening and movable between a first position and a second position. Additionally, the key lock is installed on the female fastener for controlling whether the movable member can be shifted from the first position to the second position, and the combination lock is installed on the movable member. When the movable member is in the first position, the male fastener can be locked or unlocked via the combination lock, and when the movable member is in the second position, the combination lock departs from the male fastener.

14 Claims, 11 Drawing Sheets

BUCKLE WITH DUAL LOCKING DEVICE

CROSS REFERENCE TO RELATED APPLICATION

This is a continuation-in-part application of the co-pending U.S. Ser. No. 10/792,875 application, filed on Mar. 5, 2004.

TECHNICAL FIELD

The present invention relates to a strap buckle, and more particularly, to a strap buckle with a dual locking device for fastening and locking luggage.

BACKGROUND OF THE INVENTION

A conventional buckle generally includes a male fastener and a female fastener. Another conventional buckle further includes a combination lock for controlling connections between the male fastener and the female fastener. As disclosed in Taiwan Patent No. 188582, a buckle, namely an elastic-type buckle, is provided for fastening luggage with a strap; furthermore, a combination lock is provided for controlling whether the strap can be released.

Additionally, US publication No. 2005/0155397 discloses a buckle with a strap that includes not only a combination lock but also a key lock cooperated with the combination lock so that the strap can be released via two different ways. One way is to dial a set of correct codes of the combination lock so as to allow a male fastener of the buckle releasing from the female fastener of the buckle. Another way is using a key to unlock the key lock so as to allow the male fastener of the buckle releasing from the female fastener of the buckle. Accordingly, such a buckle provides a benefit that a user can unlock the buckle via the combination lock, and a luggage inspector can unlock the buckle via the key lock by using a master key, which is unique and held by the inspector only. Therefore, the luggage can be open and inspected without damaging the buckle.

SUMMARY OF INVENTION

The present invention relates to a buckle with a dual locking device, and such buckle is preferably installed on luggage that provides advantages for luggage inspections.

More specifically, the buckle comprises a female fastener, a male fastener, a movable member, a key lock and a combination lock. The female fastener has a mounting opening, an insertion opening and two side holes defined respectively on different sides of the female fastener. Additionally, the mounting opening, the insertion opening and the two side holes are communicated with each other, and one of the two side holes is opposite to the other one of the two side holes. The male fastener is provided for inserting into the female fastener, and has two elastic pillars. Each one of the two elastic pillars has an outward projection for inserting into the corresponding one of the two side holes. Therefore, when the male fastener is inserted into the female fastener, the outward projections of the elastic pillars are inserted into the side holes respectively. The movable member is installed in the mounting opening of the female fastener and movable between a first position and a second position. The key lock is installed on the female fastener for controlling whether the movable member can be shifted from the first position to the second position. The combination lock is installed on the movable member; therefore, when the movable member is in the first position, the male fastener can be locked or unlocked via the combination lock, and when the movable member is in the second position, the combination lock departs from the male fastener.

Accordingly, the present invention further provides optimal ways in controlling the buckle via the movable member, the combination lock and the key lock.

BRIEF DESCRIPTION OF DRAWINGS

The above description of the present invention will be more fully appreciated by referring to a following detailed description of a preferred, but nonetheless illustrative embodiment, when taken in conjunction with the accompanying drawings, wherein.

DETAILED DESCRIPTION OF PREFERRED EMBODIMENTS

Figure 1:
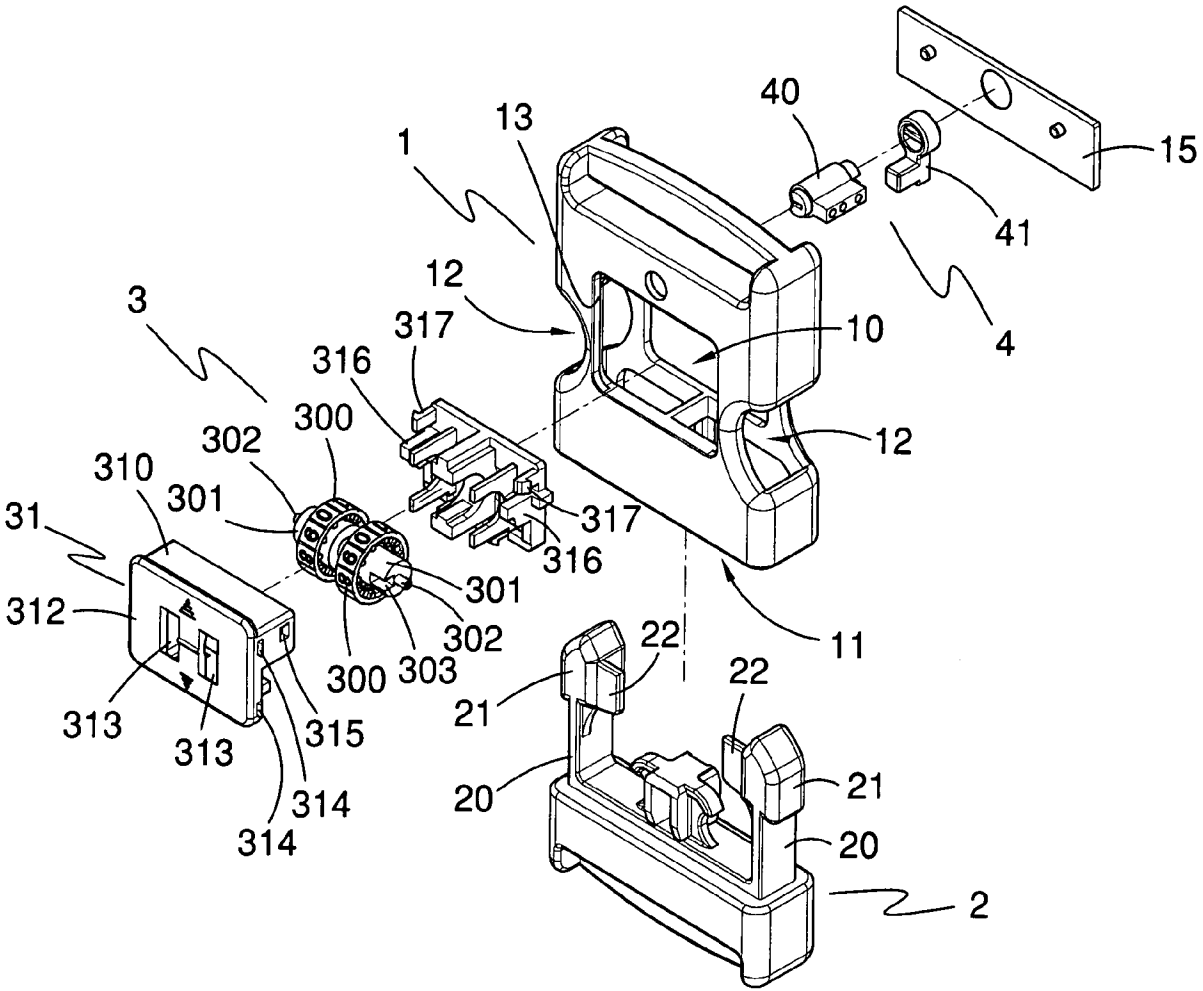
FIG. 1 is an exploded view of a buckle as a first embodiment of the present invention.
Figure 2:
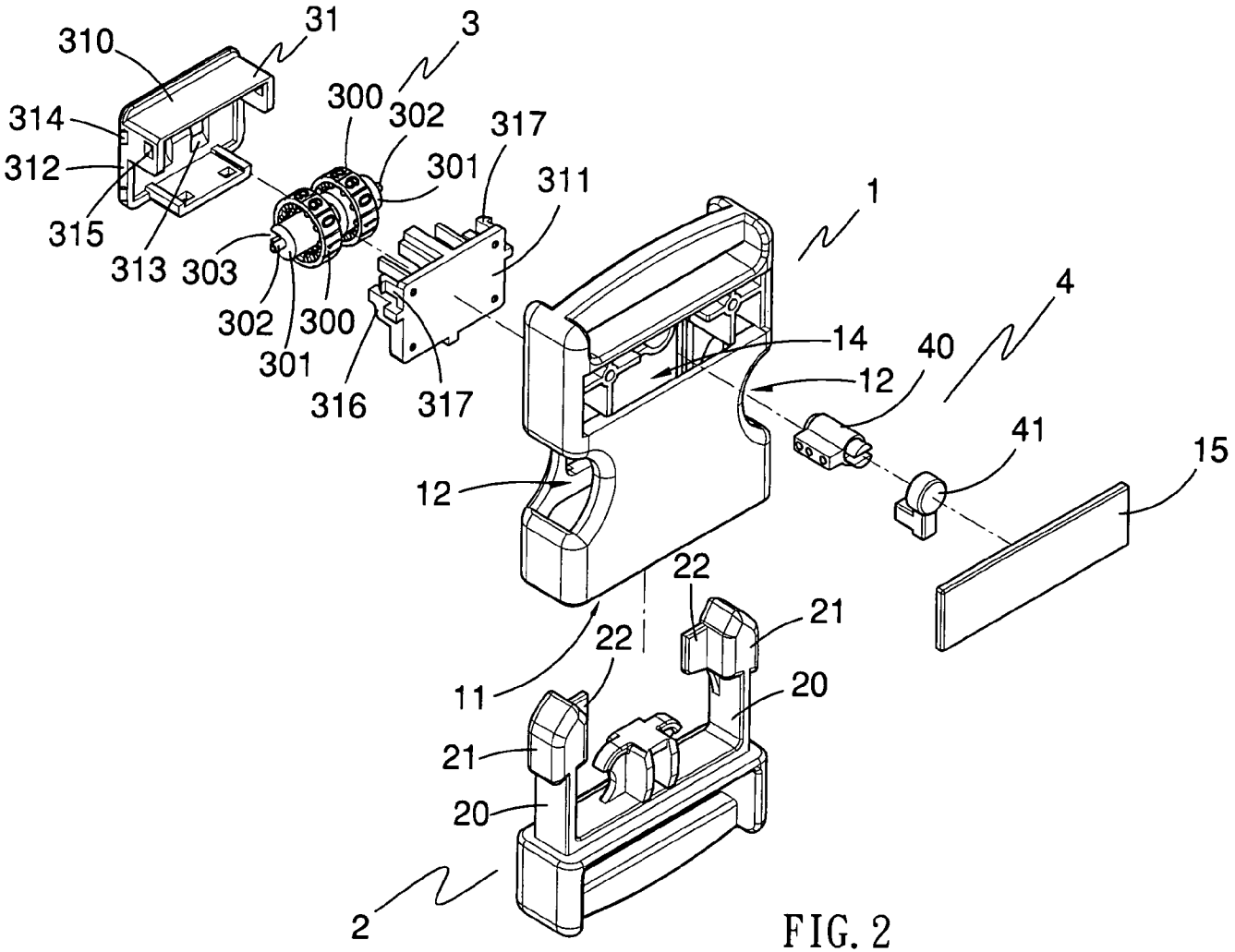
FIG. 2 is a further exploded view of the first embodiment, showing a different view of the first embodiment.

Referring to FIGS. 1 and 2, a buckle with a dual locking device as a first embodiment of the present invention comprises a female fastener 1, a male fastener 2, a movable member 31, a combination lock 3, and a key lock 4. The female fastener 1 has a mounting opening 10, an insertion opening 11 and two side holes 12 defined respectively on different sides of the female fastener 1. As shown in FIG. 1, the mounting opening 10, the insertion opening 11 and the side holes 12 are communicated with each other due to the female fastener 1 having a hollow interior; and one of the side holes 12 is opposite to the other one of the two side holes 12. More specifically, the mounting opening 11 is formed on a top of the female fastener 1, and the insertion opening 11 and the side holes 12 are respectively formed on edges of the female fastener 1. The mounting opening 10 has two sides and each side is formed with a step 13. In FIG. 2, the female fastener 1 further has a through hole 14 communicated with the interior of the female fastener 1 and the through hole 14 is covered by a cover 15.

Furthermore, the male fastener 2 is provided for inserting into the female fastener 1, and has two elastic pillars 20 for inserting into the female fastener 1 via the insertion opening 11. Each elastic pillar 20 has an outward projection 21 for inserting into the corresponding one of the side holes 12; therefore, when the elastic pillars 20 of the male fastener 2 are inserted into the female fastener 1, the outward projections 21 are correspondingly and respectively inserted into the side holes 12. Additionally, each elastic pillar 20 further has an inward projection 22, which is opposite to the corresponding outward projection 21, as shown in FIG. 1.

The movable member 31 is installed in the mounting opening 10 of the female fastener 1 and movable between a first position and a second position. Additionally, the key lock 4 is installed on the female fastener 1 for controlling whether the movable member 31 can be shifted from the first position to the second position. The combination lock 3 is installed on the movable member 31; therefore, when the movable member 31 is in the first position, the male fastener 2 can be locked or unlocked via the combination lock 3, and when the movable member 31 is in the second position, the combination lock 3 departs from the male fastener 2 so as to release the male fastener 2.

In FIGS. 1 and 2, the movable member 31 has a top shell 310 and a bottom shell 311 so as to receive the combination lock 3. The combination lock 3 has two numeral wheels 300 and two shafts 301, which are simultaneously rotatable with the numeral wheels 300. Each shaft 301 has a recess 303 and a cylinder 302 defined at an end of the shaft 301, and is extendable to the corresponding inward projection 22 of the male fastener 2; therefore, when a set of correct codes of the combination lock 3 is dialed, the recesses 303 of the shafts 301 are allowed to receive the corresponding inward projections 22 of the male fastener 2.

The top shell 310 has a push button 312 exposed to the mounting opening 10 of the female fastener 1. The push button 312 has two slots 313 for receiving the numeral wheels 300, which are accordingly exposed to the slots 313. Furthermore, the push button 312 has two edges opposite to each other, and each edge has two hooks 314 provided for engaging with the corresponding step 13 of the mounting opening 10 so as to prevent the movable member 3 releasing the mounting opening 10. Moreover, the top shell 310 further has two notches 315 respectively formed on the edges of the top shell 310, and the bottom shell 311 has two opposite sides. Each side of the bottom shell 311 has a holder 316 for holding the corresponding cylinder 302 so as to allow the shafts 301 to move between the holders 316. Furthermore, each side of the bottom shell 311 further has a latch 317 for engaging with the corresponding notch 315 of the top shell 310 in order to combine the top shell 310 and the bottom shell 311 as one.

The key lock 4 includes a lock core 40 and a limiting part 41. The lock core 40 is drivable by a specific key and provided for driving the limiting part 41 to move between a third position and a fourth position. When the limiting part 41 is in the third position, the limiting part 41 retains the movable member 31 in the first position, and when the limiting part 41 is in the fourth position, the movable member 31 can move to the second position.

Figure 3:
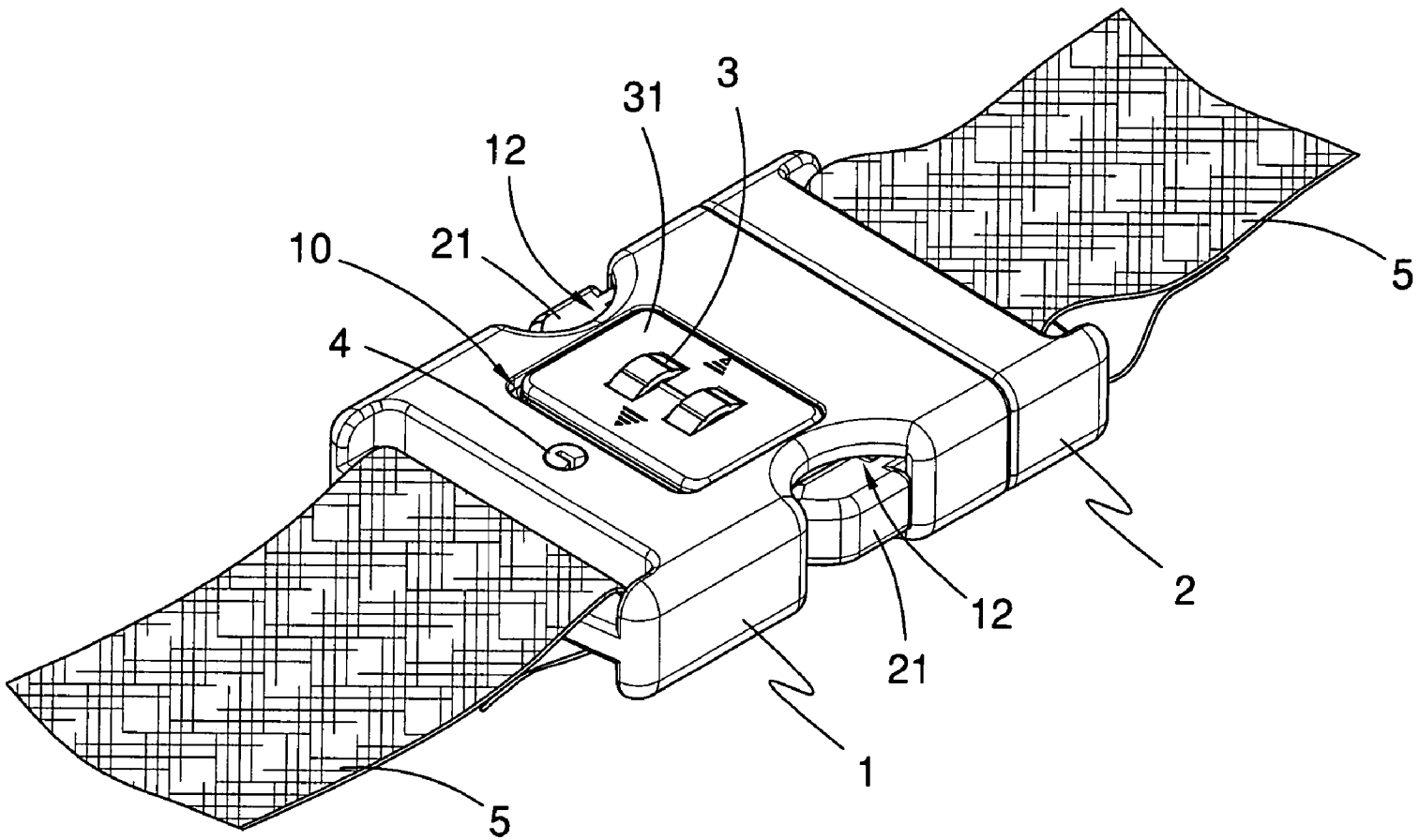
FIG. 3 is a perspective and assembly view of the first embodiment.

FIG. 3 shows the female fastener 1 is engaged with one end of a strap 5 and the male fastener 2 is engaged with the other end of the strap 5. The elastic pillars 20 of the male fastener 2 are inserted into the insertion opening 11 of the female fastener 1, which is connected with the male fastener 2 through the outward projections 21 and the side holes 12.

Figure 5:
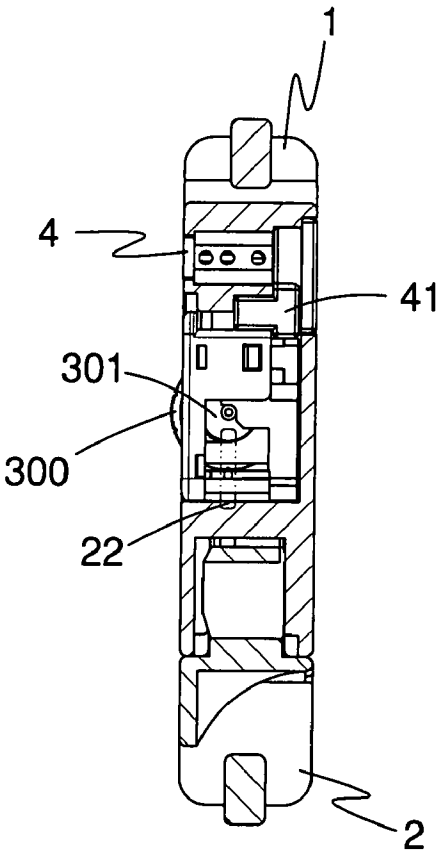
FIG. 5 is a vertical cross-sectional view of the first embodiment.
Figure 4:
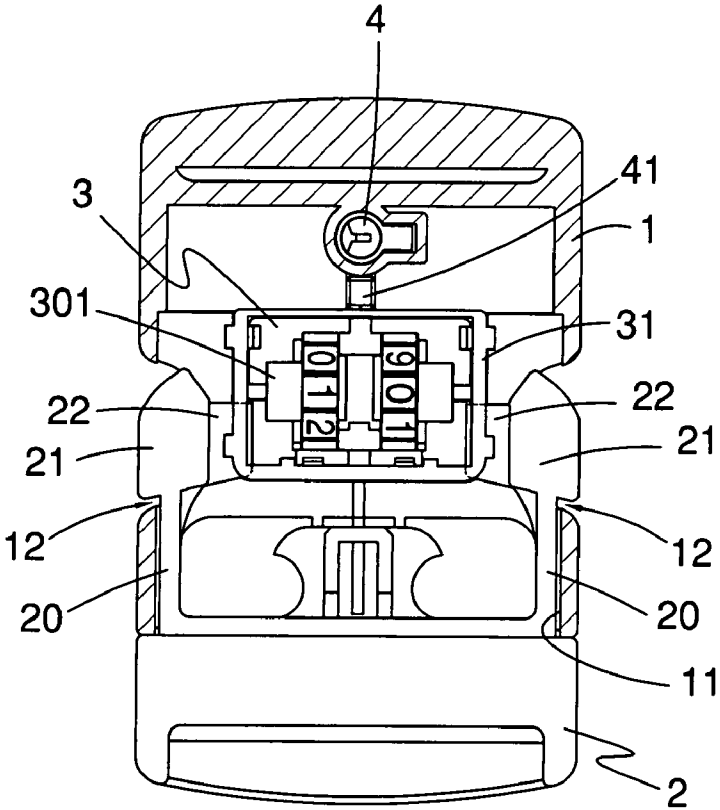
FIG. 4 is a horizontal cross-sectional view of the first embodiment, showing the buckle being locked.

FIGS. 4 and 5 show the buckle of the first embodiment being locked by the combination lock 3. The elastic pillars 20 of the male fastener 2 are inserted into the female fastener 1, and the outward projections 21 are kept within the side holes 12. The movable member 31 is in the first position. As shown in FIG. 4, the shafts 301 are against the inward projections 22 of the elastic pillars 20, and the limiting part 41 is in the third position and against the movable member 31. Accordingly, the outward projections 21 can not be pressed toward the mounting opening 10 of the female fastener 1. Thus, the buckle is locked and the male fastener 2 cannot be removed from the female fastener 1.

Figure 7:
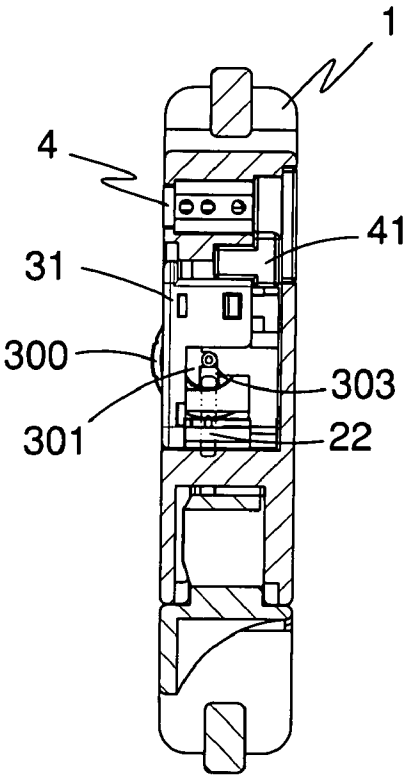
FIG. 7 is a vertical cross-sectional view of the first embodiment, showing the combination lock being unlocked.
Figure 6:
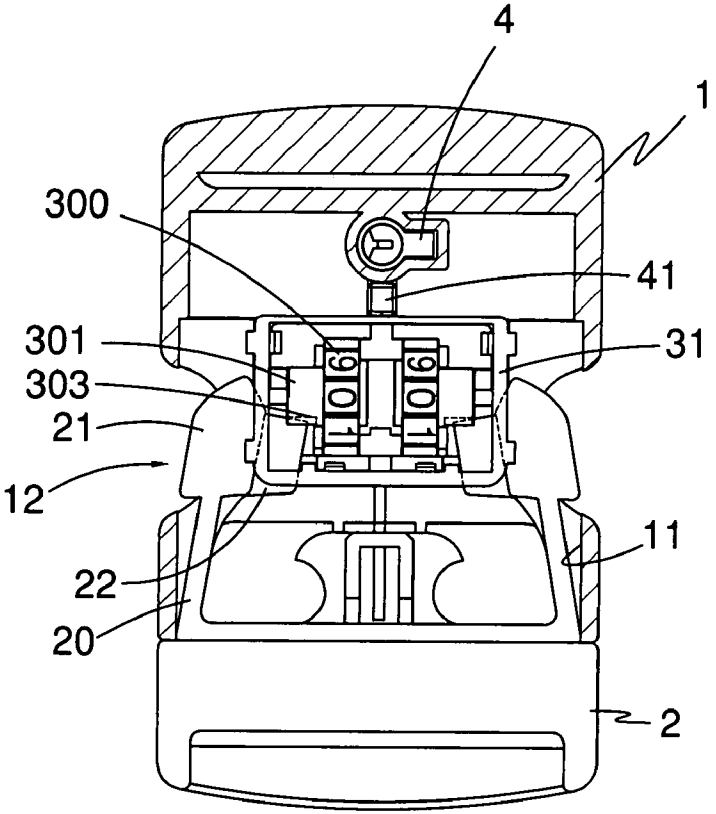
FIG. 6 is a horizontal cross-sectional view of the first embodiment, showing a combination lock being unlocked.

FIGS. 6 and 7 show the buckle of the first embodiment being unlocked by the combination lock 3. When a set of correct codes of the combination lock 3 is dialed by dialing the numeral wheels 300, the shafts 301 are rotated simultaneously so as to make the recesses 303 face to the inward projections 22. Accordingly, the outward projections 21 can be pressed toward the mounting opening 10 to allow the elastic pillars 20 distortedly moving, and the inward projections 22 can be accordingly inserted into the recesses 303 to allow the outward projections 21 releasing from the side holes 12. Accordingly, the male fastener 2 can be released from the insertion opening 11 of the female fastener 1 to unlock the buckle.

Figure 9:
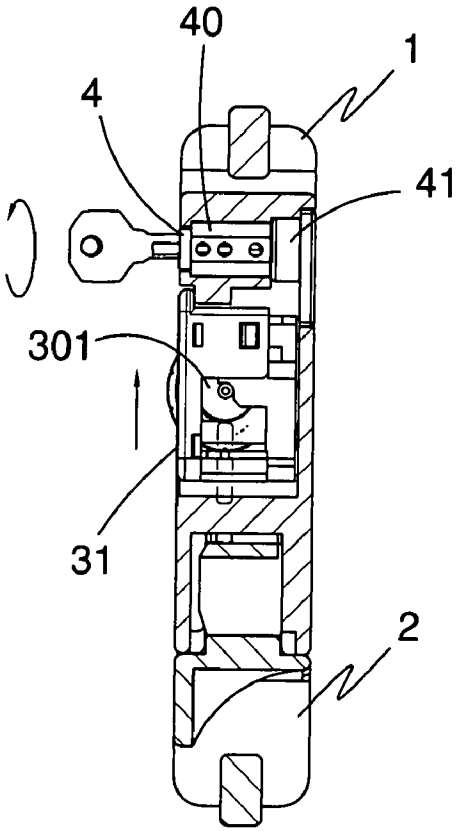
FIG. 9 is a vertical cross-sectional view of the first embodiment, showing the key lock being unlocked.
Figure 8:
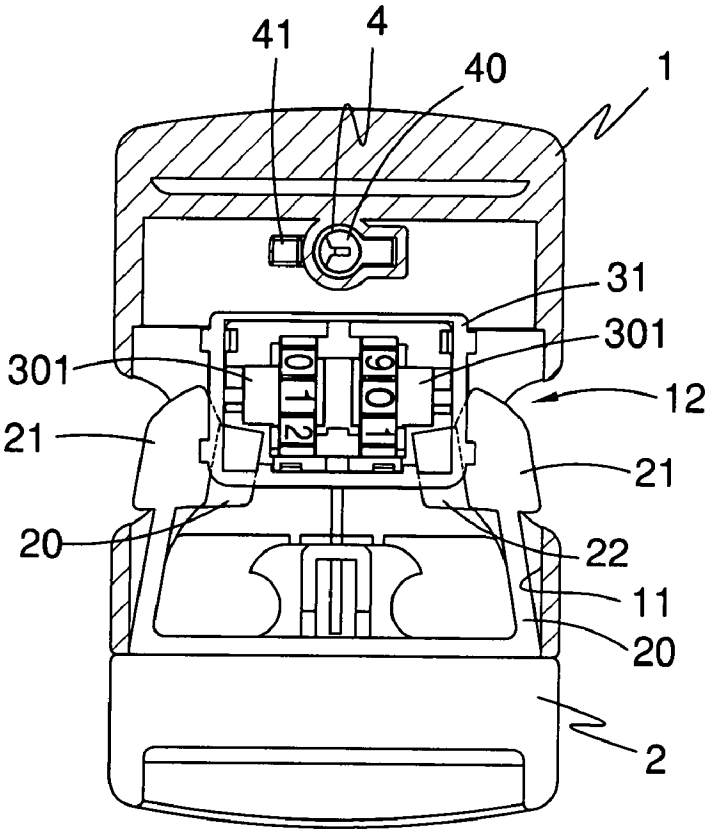
FIG. 8 is a horizontal cross-sectional view of the first embodiment, showing a key lock being unlocked.

FIGS. 8 and 9 show the buckle of the first embodiment being unlocked by the key lock 4. When the specific key is inserted into the lock core 40, the limiting part 41 can be driven and rotated to the fourth position. In the fourth position, the limiting part 41 is removed from the movable member 31. Accordingly, the movable member 31 can be moved to the second position in order to drive the numeral wheels 300 so as to have the shafts 301 moved accordingly. Thus, the shafts 301 are not against the inward projections 22. Similarly to the above descriptions, the outward projections 21 can be pressed toward the mounting opening 10 to allow the outward projections 21 releasing from the side holes 12. The male fastener 2 can be released from the insertion opening 11 of the female fastener 1 to unlock the buckle.

In the first embodiment of the present invention, the movable member 31 preferably has a dimension which is arranged for allowing the movable member 31 to move in a rectilinear movement between the first position and the second position within the mounting opening 10 of the female fastener 1.

Figure 10:
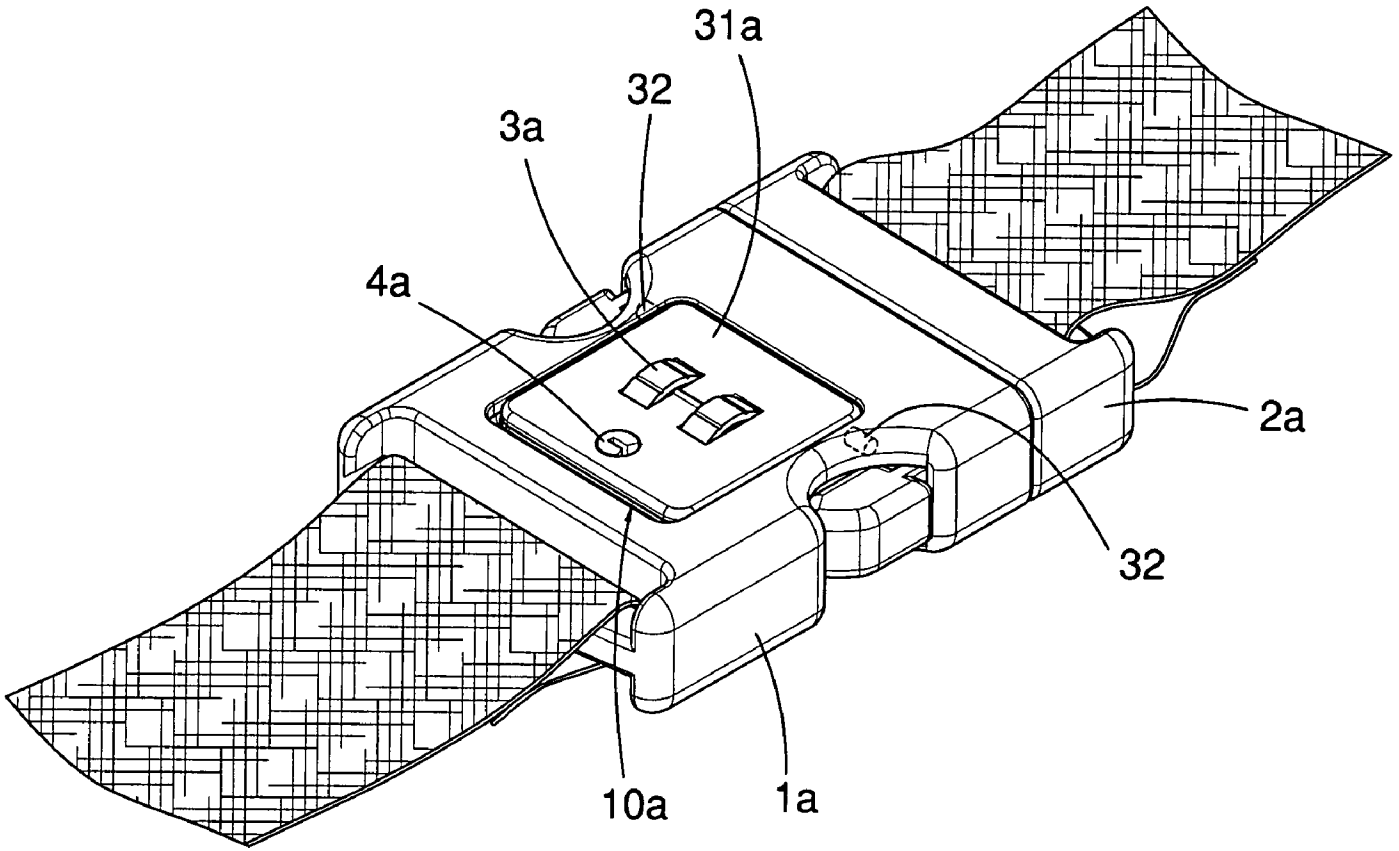
FIG. 10 is a perspective view of a buckle as a second embodiment of the present invention.
Figure 11:
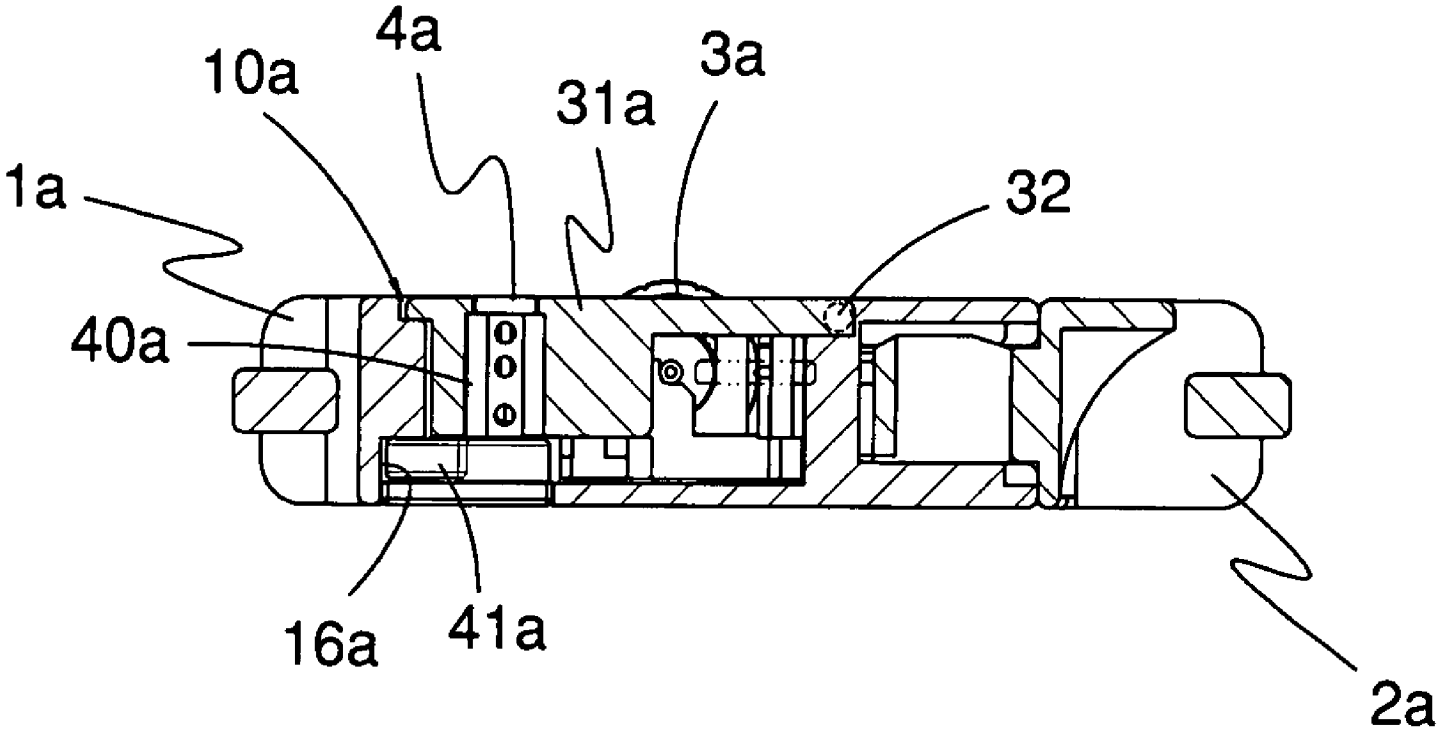
FIG. 11 is a cross-sectional view of the second embodiment.
Figure 12:
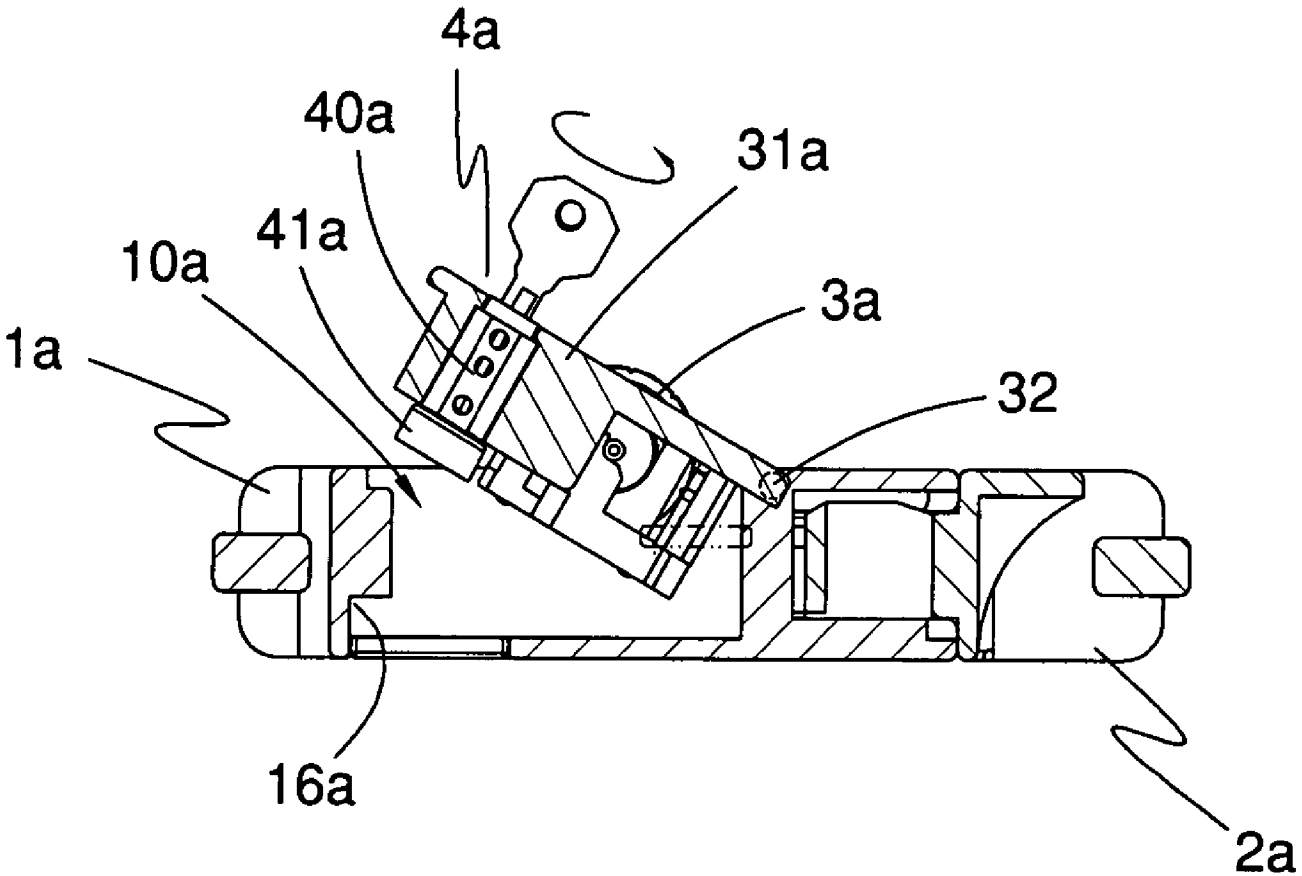
FIG. 12 is an operational view of the second embodiment.

FIGS. 10-12 further show another buckle as a second embodiment of the present invention, and the buckle of the second embodiment comprises a female fastener 1*a*, a male fastener 2*a*, a movable member 31*a*, a combination lock 3*a*, and a key lock 4*a*. The second embodiment is similar with the first embodiment except the movable member 31*a* further having two edges opposite to each other, and each edge having a pivot 32 installed in the female fastener 1*a* and arranged for allowing the movable member 31*a* rotating or swinging between the first position and the second position, as shown in FIG. 12. Additionally, the key lock 4*a* is installed on the movable member 31*a* for controlling whether the movable member 31*a* can be shifted from the first position to the second position.

In FIGS. 11 and 12, the female fastener 1*a* of the second embodiment has a groove 16*a*, and the movable member 31*a* is installed within the mounting opening 10*a* of the female fastener 1*a*. Similar to the first embodiment, the movable member 31*a* is movable between a first position and a second position via the pivots 32. Furthermore, a limiting part 41*a* of the key lock 4*a* is provided for engaging with the groove 16*a* while in a third position via a lock core 40*a* so as to retain the movable member 31*a* in the first position, as shown in FIG. 11. FIG. 12 shows that a specific key is inserted into the key lock 4*a* to drive the lock core 40*a*. The limiting part 41*a* accordingly rotates to a fourth position so as to release from the groove 16*a*. Thus, the movable member 31*a* can rotate or swing from the first position to the second position in order to unlock the male fastener 2*a*.

Figure 13:
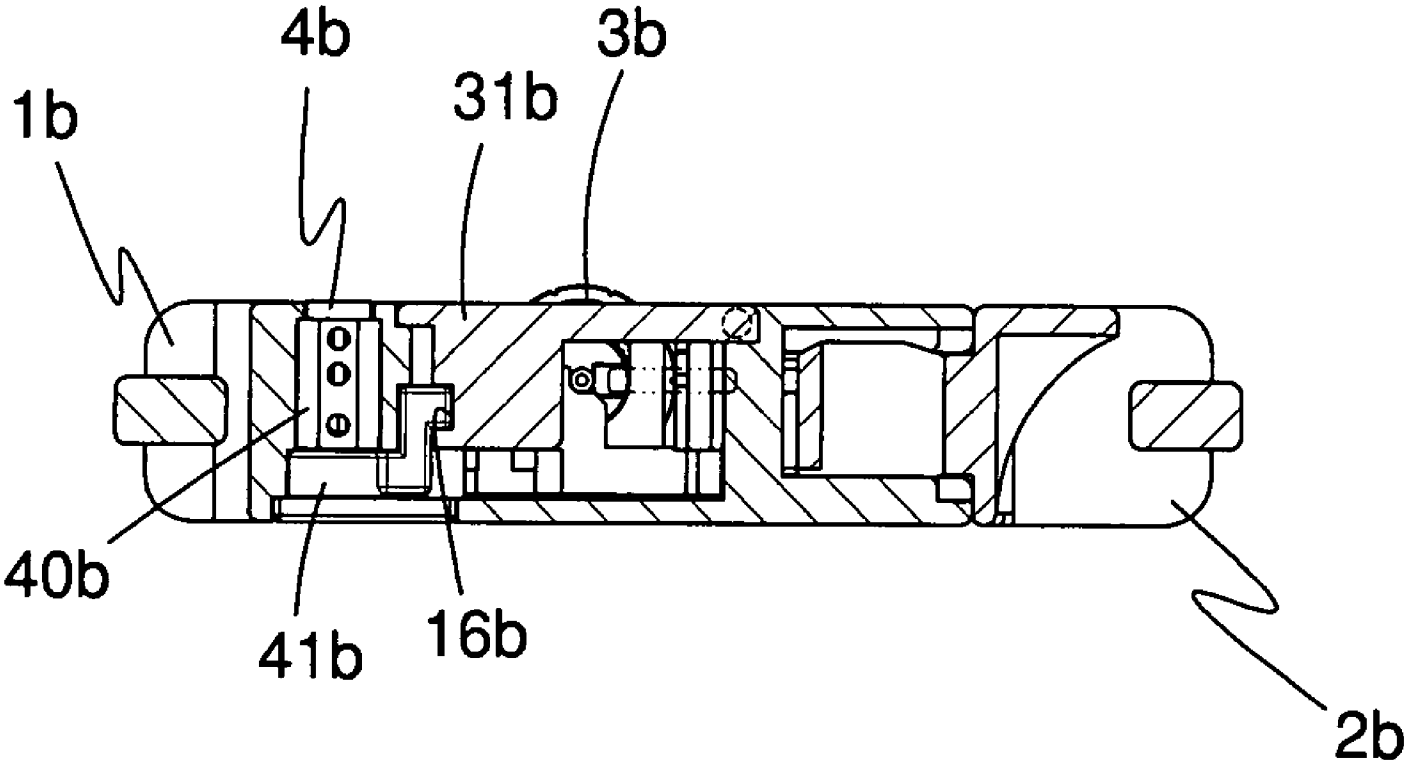
FIG. 13 is a cross-sectional view of a third embodiment of the present invention.
Figure 14:
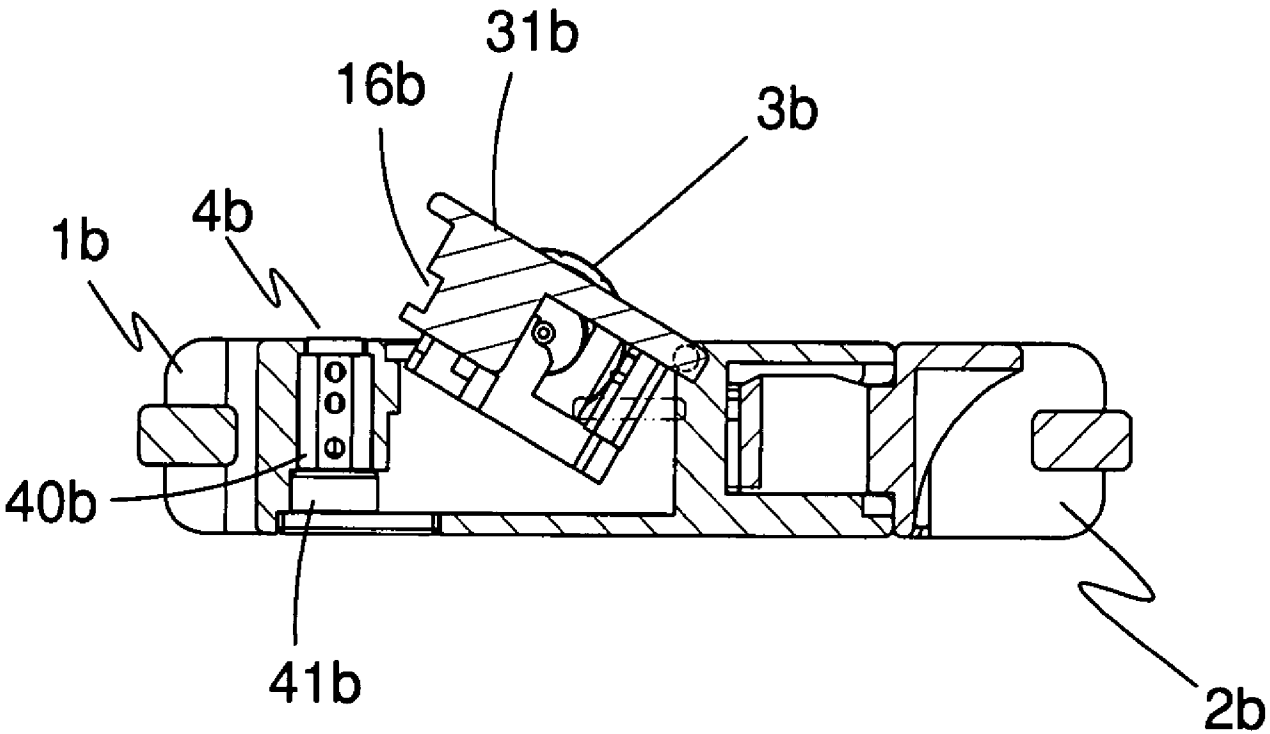
FIG. 14 is an operational view of the third embodiment.

Additionally, FIGS. 13 and 14 show a further buckle as a third embodiment of the present invention, and the buckle comprises a female fastener 1*b*, a male fastener 2*b*, a movable member 31*b*, a combination lock 3*b*, and a key lock 4*b*. The third embodiment is similar with the second embodiment except a groove 16*b* being defined in the movable member 31*b*, and the key lock 4*b* being installed in the female fastener 1*b*.

When a limiting part 41*b* of the key lock 4*b* is in a third position through a lock core 40*b*, the limiting part 41*b* is engaged with the groove 16*b* so as to retain the movable member 31*b* in a first position. Furthermore, when the lock core 40*b* is operated by a specific key, the limiting part 41*b* is accordingly moved to a fourth position so as to release from the groove 16*b*. Thus, the movable member 31*b* can rotate or swing from the first position to the second position in order to unlock the male fastener 2*b*.

As described above, a luggage owner only needs to use the combination lock to release the male fastener from the female fastener, namely to unlock the buckle, and a luggage inspector can use a master key to unlock the buckle. Accordingly, the inspector can check the luggage more effectively without damaging the same.

Numerous characteristics and advantages of the invention have been set forth in the foregoing description, together with details of the structure and function of the invention, and the novel features thereof are pointed out in appended claims. The disclosure, however, is illustrative only, and changes may be made in detail, especially, in matters of shape, size and arrangement of parts, materials and the combination thereof within the principle of the invention, to the full extent indicated by the broad general meaning of the terms in which the appended claims are expressed.

We claim:

1. A buckle with a dual locking device, comprising:

a female fastener, having a mounting opening, an insertion opening and two side holes defined respectively on different sides of the female fastener, wherein the mounting opening, the insertion opening and the two side holes are communicated with each other; and one of the two side holes is opposite to the other one of the two side holes;

a male fastener, provided for inserting into the female fastener, and having two elastic pillars, wherein each one of the two elastic pillars has an outward projection for inserting into the one of the two side holes;

a movable member, installed in the mounting opening of the female fastener and movable between a first position and a second position;

a key lock, installed on the female fastener for controlling whether the movable member can be shifted from the first position to the second position; and a combination lock, installed on the movable member;

wherein when the movable member is in the first position, the male fastener can be locked or unlocked via the combination lock, and when the movable member is in the second position, the male fastener is allowed to be released from the female fastener.

2. The buckle of claim 1, wherein:

each one of the two elastic pillars of the male fastener further has an inward projection, which is opposite to the corresponding outward projection; and the combination lock has two numeral wheels and two shafts, which are simultaneously rotatable with the two numeral wheels, wherein each of the two shafts has a recess and is extendable to the corresponding inward projection of the male fastener, and when a set of correct codes of the combination lock is dialed, each recess of the two shafts is allowed to receive the corresponding inward projection of the male fastener.

3. The buckle of claim 2, wherein the key lock includes a lock core and a limiting part, the lock core being drivable by a specific key and provided for driving the limiting part to move between a third position and a fourth position, wherein when the limiting part is in the third position, the limiting part retains the movable member in the first position, and when the limiting part is in the fourth position, the movable member can move to the second position.

4. The buckle of claim 3, wherein a dimension of the movable member is arranged for allowing the movable member moving in a rectilinear movement between the first position and the second position within the mounting opening of the female fastener.

5. The buckle of claim 4, wherein the movable member has two edges opposite to each other; and each one of the two edges has two hooks arranged for preventing the movable member releasing from the mounting opening.

6. The buckle of claim 3, wherein the movable member has two edges opposite to each other; and each one of the two edges has a pivot installed in the female fastener and arranged for allowing the movable member rotating between the first position and the second position.

7. A buckle with a dual locking device, comprising:

a female fastener, having a mounting opening, an insertion opening and two side holes defined respectively on different sides of the female fastener, wherein the mounting opening, the insertion opening and the two side holes are communicated with each other; and one of the two side holes is opposite to the other one of the two side holes;

a male fastener, provided for inserting into the female fastener, and having two elastic pillars, wherein each one of the two elastic pillars has an outward projection for inserting into the one of the two side holes;

a movable member, installed in the mounting opening of the female fastener and movable between a first position and a second position;

a key lock, installed on the movable member for controlling whether the movable member can be shifted from the first position to the second position; and a combination lock, installed on the movable member;

wherein when the movable member is in the first position, the male fastener can be locked or unlocked via the combination lock, and when the movable member is in the second position, the key lock and the combination lock depart from the male fastener.

8. The buckle of claim 7, wherein:

each one of the two elastic pillars of the male fastener further has an inward projection, which is opposite to the corresponding outward projection; and the combination lock has two numeral wheels and two shafts, which are simultaneously rotatable with the two numeral wheels, wherein each of the two shafts has a recess and is extendable to the corresponding inward projection of the male fastener, and when a set of correct codes of the combination lock is dialed, each recess of the two shafts is allowed to receive the corresponding inward projection of the male fastener.

9. The buckle of claim 8, wherein the key lock includes a lock core and a limiting part, the lock core being drivable by a specific key and provided for driving the limiting part to move between a third position and a fourth position, wherein when the limiting part is in the third position, the limiting part retains the movable member in the first position, and when the limiting part is in the fourth position, the movable member can move to the second position.

10. The buckle of claim 9, wherein the movable member has two edges opposite to each other; and each one of the two edges has a pivot installed in the female fastener and arranged for allowing the movable member rotating between the first position and the second position.

11. A buckle with a dual locking device comprising:

a male fastener including two elastic pillars each having an outward protrusion;

a female fastener defining an insertion opening and two side holes in communication with the insertion opening; the insertion opening provided for being inserted by the two elastic pillars of the male fastener; the two side holes provided for receiving the outward protrusions of the elastic pillars respectively to fasten the male fastener and the female fastener;

a key lock disposed on the female fastener and being capable of controlling whether the male fastener can be released from the female fastener; and a combination lock disposed on the female fastener being capable of controlling whether the male fastener can be released from the female fastener.

12. The buckle of claim 11 further comprising a movable member disposed on the female fastener and movable between a first position and a second position wherein when the movable member is in the first position, the male fastener can be locked or unlocked via the combination lock, and when the movable member is in the second position, the male fastener is allowed to be released from the female fastener.

13. A buckle lock comprising:

a male fastener including two elastic pillars each having an outward protrusion;

a female fastener defining an insertion opening and two side holes in communication with the insertion opening: the insertion opening provided for being inserted by the two elastic pillars of the male fastener; the two side holes provided for receiving the outward protrusions of the elastic pillars respectively to fasten the male fastener and the female fastener; and a means including including a key lock and a combination lock for controlling whether the male fastener can be released from the female fastener by inserting a key or dialing a combination.

14. The buckle lock of claim 13 further comprising a movable member disposed on the female fastener and movable between a first position and a second position wherein when the movable member is in the first position, the male fastener can be locked or unlocked via the combination lock, and when the movable member is in the second position, the male fastener is allowed to be released from the female fastener.

* * * * *